United States Patent [19]

Gandhi et al.

[11] Patent Number: 4,499,863

[45] Date of Patent: Feb. 19, 1985

[54] METHOD OF OPERATING AN INTERNAL COMBUSTION ENGINE ON A METHANOL FUEL

[75] Inventors: Haren S. Gandhi, Farmington Hills, Mich.; William L. H. Watkins, Toledo, Ohio

[73] Assignee: Ford Motor Company, Dearborn, Mich.

[21] Appl. No.: 439,154

[22] Filed: Nov. 4, 1982

[51] Int. Cl.[3] ..... F02M 27/02

[52] U.S. Cl. ..... 123/3; 123/DIG. 12

[58] Field of Search ..... 123/1 A, 3, DIG. 12

[56] References Cited

U.S. PATENT DOCUMENTS

| | | | |
|---|---|---|---|
| 4,170,200 | 10/1979 | Takeuchi et al. | 123/3 |
| 4,304,761 | 12/1981 | Yu Yao | 60/299 |
| 4,318,369 | 3/1982 | Cronya | 123/3 |
| 4,366,782 | 1/1983 | Jackson et al. | 123/3 |

*Primary Examiner*—William A. Cuchlinski, Jr.
*Attorney, Agent, or Firm*—William E. Johnson; Olin B. Johnson

[57] ABSTRACT

This specification teaches a method of operating an internal combustion engine having combustion chambers on a methanol fuel. In general, the method teaches the steps of heating the fuel to vaporize at least a portion thereof, thereafter heating at least a portion of the vaporized fuel to a decomposition temperature. At least a portion of the vaporized methanol fuel at the decomposition temperature is passed over a catalyst selected from the group consisting essentially of a palladium catalyst, a platinum/palladium catalyst, and a platinum/rhodium catalyst, thereby to decompose at least a part of the vaporized methanol fuel into hydrogen and carbon monoxide. The vaporized methanol fuel, along with the hydrogen and carbon monoxide, are injected into the combustion chambers of the internal combustion engine along with oxygen and, if desired, additional methanol fuel to be burned in the combustion chambers. The fuel and decomposition products thereof are burned within the combustion chambers and exhaust gases produced thereby exhausted from the combustion chambers. Additionally, the method teaches that the exhaust gases may be used in the heating of the fuel to its vaporized state and then to its decomposition temperature.

6 Claims, 1 Drawing Figure

TEMPERATURE FOR METHANOL DECOMPOSITION

| CATALYST DESCRIPTION | T °(C) FOR METHANOL DECOMPOSITION | | | | |
|---|---|---|---|---|---|
| | 25% | 50% | 75% | 90% | 95% |
| NiO (Ni = 1 wt %) | 340 | 388 | 625 | N.R. | N.R. |
| 3% CuO+1.5% ZnO+0.2% $Cr_2O_3$ | 290 | 450 | 625 | N.R. | N.R. |
| Ag (0.5 wt %) | 285 | 600 | N.R. | N.R. | N.R. |
| Pt+Pd=0.1 wt %, (Pt/Pd = 2/1 | 290 | 325 | 400 | 475 | N.R |
| Pt+Rh =0.2 wt %, (Pt/Rh = 1/1 | 250 | 280 | 330 | 380 | 410 |
| Pt+Rh =0.1 wt % (Pt/Rh = 5/1 | 265 | 295 | 320 | 370 | N.R. |
| Pd = 0.2 wt % | 275 | 300 | 340 | 405 | 490 |

N.R. = NOT REACHED

TEMPERATURE FOR METHANOL DECOMPOSITION

| CATALYST DESCRIPTION | T°(C) FOR METHANOL DECOMPOSITION | | | | |
|---|---|---|---|---|---|
| | 25% | 50% | 75% | 90% | 95% |
| NiO (Ni = 1 wt %) | 340 | 388 | 625 | N.R. | N.R. |
| 3% CuO+1.5% ZnO+0.2% $Cr_2O_3$ | 290 | 450 | 625 | N.R. | N.R. |
| Ag (0.5 wt %) | 285 | 600 | N.R. | N.R. | N.R. |
| Pt+Pd=0.1 wt %, (Pt/Pd = 2/1 | 290 | 325 | 400 | 475 | N.R |
| Pt+Rh =0.2 wt %, (Pt/Rh = 1/1 | 250 | 280 | 330 | 380 | 410 |
| Pt+Rh =0.1 wt % (Pt/Rh = 5/1 | 265 | 295 | 320 | 370 | N.R. |
| Pd = 0.2 wt % | 275 | 300 | 340 | 405 | 490 |

N.R. = NOT REACHED

METHOD OF OPERATING AN INTERNAL COMBUSTION ENGINE ON A METHANOL FUEL

TECHNICAL FIELD

This specification is directed to a method of operating an internal combustion engine on a methanol fuel. The method involves vaporizing at least a portion of the methanol fuel and then passing it over a catalyst selected from the group consisting essentially of a palladium catalyst, a platinum/palladium catalyst, and a platinum/rhodium catalyst, thereby to decompose at least a part of the vaporized methanol fuel into hydrogen and carbon monoxide.

BACKGROUND ART AND PRIOR ART STATEMENT

Methanol fuel is considered as an alternative fuel for internal combustion engines and in the recent past use of methanol fuel has been studied by many researchers. For example, reference is made to W. H. Baisley and C. F. Edwards, presented at IV International Symposium on Alcohol Fuels Technology, Guarja-SP, Brazil, Oct. 5, 1980, wherein discussions are set forth concerning the manner in which a methanol fuel may be used in an internal combustion engine.

One method of using a methanol fuel is to have a system in which hydrogen and carbon monoxide are generated by reforming methanol catalytically into these components. This catalytic generation of carbon monoxide and hydrogen offers a substantial improvement in the thermal efficiency of an internal combustion engine operating on methanol fuel over a similar engine operating on gasoline.

The preferred reforming reaction for methanol is one in which one mole of methanol is converted to one mole of carbon monoxide and two moles of hydrogen. This reaction is an endothermic reaction, and the reformed gas has a 20% higher heating value than the methanol gas. In other words, the reaction to form carbon monoxide and hydrogen is one in which heat is absorbed so that the reaction products contain a higher amount of thermal energy than the products reacted. Burning of these higher energy products in the combustion cylinders of the internal combustion engine produces higher operating temperatures and therefore greater thermal efficiencies in the combustion process. Increase in the thermal efficiencies, of course, results in greater miles per gallon for the methanol fuel being burned.

Other efficiencies are also involved with the burning of a methanol fuel which has at least partially been reformed into carbon monoxide and hydrogen. For example, one of the additional efficiencies is found in the fact that the reformed product has a higher burn rate which thereby permits the internal combustion engine to be operated under leaner air/fuel mixture conditions thereby, once again, improving the overall thermal efficiency of the engine. As an additional matter, the methanol fuel, which is at least partially transformed into the carbon monoxide and hydrogen gas, offers superior antiknock properties when burned in an internal combustion engine. The superior antiknock properties allows the compression ratio of the engine to be increased from 8.5–9.0:1 to a ratio of approximately 14.0:1. This improvement in compression ratio, once again, allows improved thermal efficiency of the engine which all equates to improved miles per gallon of fuel burnt.

DISCLOSURE OF THE INVENTION

This invention is directed to a method of operating an internal combustion engine and, more particularly, to a method of operating an internal combustion engine having combustion chambers on a methanol fuel.

The method of our invention is characterized in the following steps. At least a portion of the methanol fuel to be burned is heated to a temperature at which at least a portion of the heated methanol fuel vaporizes. At least a portion of the vaporized methanol fuel is then heated to a decomposition temperature. Thereafter, at least a portion of the vaporized methanol fuel heated to the decomposition temperature is passed over a catalyst. The catalyst is selected from the group of catalysts consisting essentially of a palladium catalyst, a platinum/palladium catalyst, and a platinum/rhodium catalyst. The catalyst is effective to decompose at least a part of the varporized methanol fuel passing thereover into hydrogen and carbon monoxide gas. The vaporized methanol fuel, along with the hydrogen and carbon monoxide which are the decomposition products resulting when a portion of the vaporized methanol fuel was passed over the catalyst, are injected into the combustion chambers of the internal combustion engine. Also injected into the internal combustion chambers are oxygen and, if desired, unvaporized methanol fuel. The fuel and decomposition products thereof confined within the combustion chambers are then burned. Once the burning of the fuel and decomposition products thereof is completed, the exhaust gases generated by burning the same are exhausted from the combustion chambers.

In accordance with details of further methods of this invention, the exhaust gases generated by burning the fuel and decomposition products thereof in the combustion chambers are used to heat the methanol fuel to vaporize at least a portion thereof and to heat the vaporized methanol fuel to a decomposition temperature.

BRIEF DESCRIPTION OF THE FIGURE

The novel features that are considered characteristic of the invention are set forth with particularlity in the appended claims. The invention itself, however, both as to its organization and its method of operation, together with additional objects and advantages thereof, will best be understood from the following description of specific embodiments when read in conjunction with the accompanying FIGURE in which a chart is provided to show the temperature for methanol decomposition in degrees centigrade versus the type of catalyst used to achieve that decomposition.

BEST MODE AND INDUSTRIAL APPLICABILITY

The following description is what we consider to be a preferred embodiment of our method of operating an internal combustion engine on a methanol fuel. The following description also sets forth what we now contemplate to be the best mode of carrying out the method of this invention. This description is not intended to be a limitation upon the broader principles of this method.

The method of this invention is directed to a method of operating an internal combustion engine having combustion chambers on a methanol fuel. By a methanol fuel, we mean a substantially pure methanol fuel or a methanol fuel which contains at least about 95% substantially pure methanol with up to about 5% by volume of a cold start hydrocarbon fuel such as isopentane. The cold start fuel is one which is added to methanol to achieve better starting characteristics when the internal combustion engine is operating under relatively cold conditions. Therefore, in the remaining portion of this specification and the claims, the term "methanol fuel" will be defined as above stated.

The method of our invention is initiated by heating at least a portion of the methanol fuel to a temperature at which at least a portion of the heated methanol fuel is vaporized. Under certain engine operating conditions, it may be desirable that all of the methanol fuel which is to be burned in the engine be heated to a point at which it vaporizes. However, under normal engine operating conditions it would appear that at least a minimum of 5% of the total methanol fuel to be burned in the engine should be vaporized with a preferred range of vaporized fuel at a level from 10–20%. If desired, all of the methanol can be vaporized. Normally methanol boils at a temperature of 65° C. The heat required to vaporize some or all of the methanol fuel to be burned in the engine can be provided in one of several ways. An electrical heater could be set up which operates through the electrical system of the motor vehicle. Also, waste heat exhausted from the combustion chambers of the internal combustion engine could be used in a heat exchange device to give heat to that portion of the methanol fuel which is to be vaporized. Also it is possible that there could be a combination of electrical heat and waste heat from the exhaust gases during a period from the initial starting of the vehicle until the vehicle reaches an operational temperature.

At least a portion of the methanol fuel which has been vaporized is heated to a decomposition temperature. Once again, all of the fuel vaporized may be heated to the decomposition temperature. However, under most engine operating conditions, less than all of the vaporized fuel need be heated to a decomposition temperature. By a decomposition temperature, we mean a temperature at which a catalytic decomposition (and not gas phase homogeneous decomposition) of the methanol fuel can take place. This decomposition temperature should be a temperature below 400° C., and preferably in a range from 320°–350° C. The reason that the decomposition temperature should be below 400° C. is that above that temperature catalytic decomposition of methanol tends to form a great deal of soot. Such soot formation, of course, causes problems such as increased back pressure and decreased catalyst efficiency. Therefore, in accordance with the terminology used in this specification and claims, the term "decomposition temperature" means a temperature below about 400° C., and preferably a temperature in the range from 320°–350° C.

We have found that in order to achieve a decomposition of heated vaporized methanol fuel at a decomposition temperature, three particular catalyst systems can be used as the decomposition catalyst. These catalysts are a palladium catalyst, a platinum/palladium catalyst, and a platinum/rhodium catalyst. Each of these three catalyst systems will be discussed below.

The palladium catalyst system preferred is one which has about 0.2 weight percent catalyst on a substrate, the substrate generally being a material such as gamma alumina. However, palladium catalysts may range from 0.05 to 1.0% by weight of the substrate upon which it is supported.

The platinum/palladium catalyst most preferred is one in which the platinum to palladium ratio is 2:1. This catalyst system is preferably found on a substrate at 0.1 weight percent of the substrate material. Once again, however, this catalyst may be present on the substrate in a range from 0.05–1.0% by weight. Also, the ratios of platinum to palladium may vary from a ratio of 4:1 to 1:4.

The platinum/rhodium catalyst is generally found in a ratio in the range of 11:1 to 5:1 as a preferred ratio. Once again, this catalyst is generally preferred at a weight of 0.1% by weight of the substrate upon which it is formed. However, once again, it may be present on the substrate in a weight percent range from 0.05–1.0. As an additional matter, the platinum/rhodium catalyst may have ratios of these materials ranging from 20:1 to 1:1.

The vaporized methanol fuel is passed at the decomposition temperature over a catalyst selected from the group consisting essentially of a palladium catalyst, a platinum/palladium catalyst, and a palladium/rhodium catalyst, thereby to decompose at least a part of the vaporized methanol fuel into hydrogen and carbon monoxide.

The FIGURE compares some catalysts with the decomposition temperature needed to get a certain percentage decomposition of the methanol fuel. It should be noted in the FIGURE that a nickel oxide 1.0% by weight catalyst requires a temperature of 625° C. in order to decompose 75% of the methanol fuel passing thereover. A mixed catalyst system containing copper oxide, zinc oxide, and chrome oxide similarly requires a 625° C. temperature in order to achieve 75% decomposition of vaporized methanol fuel passing thereover. In the case of a 0.5% by weight silver catalyst, a temperature of 600° achieves only a 50% methanol decomposition. A temperature of 400° C. is a temperature when soot forms on a noble metal catalyst. For a less active base metal oxide catalyst, soot is not a problem because such base metal oxides are not active in the first place.

The last four catalysts listed in the FIGURE are all catalyst systems which fall within the teachings of this invention. It should be noted that these catalyst systems all produce at least 75% methanol decomposition at a temperature of 400° C. or less. The two platinum/rhodium catalysts produce 90% decomposition of the methanol fuel passing thereover at temperatures below 400° C.

Thus the FIGURE illustrates that the catalysts selected for the methanol decomposition are particularly useful in this decomposition reaction because substantial conversions of the methanol can be achieved at decomposition temperatures of 400° or less. The other catalyst systems require excessive decomposition temperatures in order to achieve a preferred level of decomposition efficiency.

The next step in the method of our invention is the step of injecting the vaporized methanol fuel along with the hydrogen and carbon monoxide which are the decomposition products thereof into the combustion chambers of the internal combustion engine. Additionally, there is injected along with this material, oxygen (generally as air) and, if desired, depending upon the operating conditions of the engine, unvaporized methanol fuel. The fuel and decomposition products thereof which were confined within the combustion chambers are then burned. The burning operation is initiated, in the normal manner, by the utilization of a spark plug.

At this point we would like to discuss the fact that the decomposition of methanol to carbon monoxide and hydrogen is an endothermic reaction. By this it is meant that this reaction takes up heat from the surrounding ambient and converts that heat into the chemical potential of the fuel being created. Thus, depending upon the initial temperature of the methanol passing over the decomposition catalyst, the fuel passing out of the decomposition step, which now contains both carbon monoxide, hydrogen and vaporized methanol, will have a substantially lower temperature. For example, if the temperature of the incoming fuel was in the range of 320°-350° C., the exit fuel would have a temperature in the range of 260°-280° C., depending upon the total amount of methanol fuel converted to carbon monoxide and hydrogen. The energy used in this endothermic reaction, of course, is that energy which was used to heat the methanol to its vaporization temperature and to heat that portion of the vaporized fuel which is heated to the decomposition temperature. For each mole of methanol converted to carbon monoxide and hydrogen fuel, the converted fuel will generated 20% more energy per mole when burned. Because the converted fuel has 20% more energy per mole, the fuel has better thermodynamic properties and when burned will result in higher fuel economy, higher fuel burn rate, and superior antiknock properties.

After the fuel and decomposition products thereof have been burned, the exhaust gases generated by that burning action are exhausted from the combustion chambers. Normally these exhaust gases will have an exhaust temperature in excess of a temperature in the range of 400°-450° C. The exhaust gases may be used as aforesaid in heating the methanol fuel to vaporize the same and in heating the vaporized methanol fuel to a decomposition temperature.

In order for the exhaust gases to meet the air quality standards set by the state and federal governments, it may be necessary to treat the exhaust gases with an after-exhaust gas treatment system. Such a treatement system is described in U.S. Pat. No. 4,304,761 assigned to Ford Motor Company.

While particular embodiments of the invention have been illustrated and described, it will be obvious to those skilled in the art that various changes and modifications may be made without departing from the invention, and it is intended to cover in the appended claims all such modifications and equivalents as fall within the true spirit and scope of this invention.

We claim:

1. A method of operating an internal combustion engine having combustion chambers on a methanol fuel which is characterized by the steps of:

heating at least a portion of the methanol fuel to a temperature at which at least a portion of said heated methanol fuel is vaporized;

heating at least a portion of said vaporized methanol fuel to a decomposition temperature;

passing at least a portion of said vaporized methanol fuel at said decomposition temperature over a catalyst selected from the group consisting essentially of a palladium catalyst, a platinum/palladium catalyst, and a palladium/rhodium catalyst, thereby to decompose at least part of said vaporized methanol fuel into hydrogen and carbon monoxide;

injecting said vaporized methanol fuel along with said hydrogen and carbon monoxide which are the decomposition products thereof into the combustion chambers of the internal combustion engine along with oxygen and, if desired, additional methanol fuel to be burned in the combustion chambers;

burning the fuel and decomposition products thereof confined within the combustion chambers; and exhausting from the combustion chambers exhaust gases generated by said burning of said fuel and decomposition products thereof.

2. The method of claim 1, wherein said exhaust gases generated by burning of said fuel and decomposition products thereof are used in heating the methanol fuel to vaporize the same and in heating the said vaporized methanol fuel to a decomposition temperature.

3. A method of operating an internal combustion engine having combustion chambers on a methanol fuel which is characterized by the steps of:

heating at least a portion of the methanol fuel to a temperature at which at least a portion of said heated methanol fuel is vaporized;

heating at least a portion of said vaporized methanol fuel to a decomposition temperature of about no more than 400° C.;

passing at least a portion of said vaporized methanol fuel at said decomposition temperature over a catalyst selected from the group of catalysts consisting essentially of a palladium catalyst formed of 0.05% to 1.0% by weight of palladium on a catalyst substrate, a platinum/palladium catalyst having a ratio of platinum to palladium in a range from 4:1 to 1:4 and being present on a catalyst substrate in a range from 0.05-1.0% by weight and a platinum/-rhodium catalyst having a ratio of platinum to rhodium in a range from 20:1 to 1:1 and being present on a catalyst substrate at a range from 0.05-1.0% by weight, thereby to decompose at least part of said vaporized methanol fuel into hydrogen and carbon monoxide;

injecting said vaporized methanol fuel along with said hydrogen and carbon monoxide which are the decomposition products thereof into the combustion chambers of the internal combustion engine along with oxygen and, if desired, additional methanol fuel to be burned in the combustion chamber;

burning the fuel and decomposition products thereof confined within the combustion chamber; and exhausting from the combustion chambers exhaust gases generated by burning of said fuel and decomposition products thereof.

4. The method of claim 3, wherein said exhaust gases generated by burning of said fuel and decomposition products thereof are used in heating the methanol fuel to vaporize the same and in heating the said vaporized methanol fuel to a decomposition temperature.

5. A method of operating an internal combustion engine having combustion chambers on a methanol fuel which is characterized by the steps of:

heating at least a portion of the methanol fuel to a temperature at which at least a portion of said heated methanol fuel is vaporized;

heating at least a portion of said vaporized methanol fuel to a decomposition temperature in the range from 320°-350° C.;

passing at least a portion of said vaporized methanol fuel at said decomposition temperature over a catalyst selected from the group consisting essentially of a palladium catalyst being about 0.2% by weight on a catalyst substrate, a platinum/palladium catalyst in which the platinum to palladium ratio is 2:1 being present on a catalyst substrate at 0.1% by weight, and a platinum/rhodium catalyst having a ratio of platinum to rhodium in a range from 11:1 to 5:1 and being present on a catalyst substrate at 0.1% by weight, thereby to decompose at least part of said vaporized methanol fuel into hydrogen and carbon monoxide;

injecting said vaporized methanol fuel along with said hydrogen and carbon monoxide which are the decomposition products thereof into the combustion chambers of the internal combustion engine along with oxygen and, if desired, additional methanol fuel to be burned in the combustion chambers;

burning the fuel and decomposition products thereof confined within the combustion chambers; and exhausting from the combustion chambers exhaust gases generated by said burning of said fuel and decomposition products thereof.

6. The method of claim 5, wherein said exhaust gases generated by burning of said fuel and decomposition products thereof are used in heating the methanol fuel to vaporize the same and in heating the said vaporized methanol fuel to a decomposition temperature.

* * * * *